US007605793B2

(12) United States Patent
Lee

(10) Patent No.: US 7,605,793 B2
(45) Date of Patent: Oct. 20, 2009

(54) SYSTEMS FOR DISPLAY IMAGES INCLUDING TWO GATE DRIVERS DISPOSED ON OPPOSITE SIDES OF A PIXEL ARRAY

(75) Inventor: Szu-Hsien Lee, Kaohsiung (TW)

(73) Assignee: TPO Displays Corp., Miao-Li County (TW)

( * ) Notice: Subject to any disclaimer, the term of this patent is extended or adjusted under 35 U.S.C. 154(b) by 533 days.

(21) Appl. No.: 11/467,937

(22) Filed: Aug. 29, 2006

(65) Prior Publication Data

US 2008/0055282 A1 Mar. 6, 2008

(51) Int. Cl.
*G09G 3/36* (2006.01)

(52) U.S. Cl. ..... 345/100; 345/98

(58) Field of Classification Search ..... 345/87, 345/98, 100, 99, 204
See application file for complete search history.

(56) References Cited

U.S. PATENT DOCUMENTS 5,949,397 A * 9/1999 Koyama et al. ..... 345/100
7,106,316 B2 * 9/2006 Tanaka ..... 345/204
2004/0257322 A1 * 12/2004 Moon ..... 345/87
2005/0195151 A1 * 9/2005 Ko et al. ..... 345/100

* cited by examiner

*Primary Examiner*—Chanh Nguyen
*Assistant Examiner*—Kwang-Su Yang
(74) *Attorney, Agent, or Firm*—Thomas, Kayden, Horstemeyer & Risley

(57) ABSTRACT

Systems for displaying images are provided, comprising a pixel array, a first gate driver and a second gate driver. The first gate driver is disposed on a first side of the pixel array and the second gate driver is disposed on a second side opposite to the first side. The first gate driver comprises a first shift register and a first AND gate. The first shift register receives a first clock signal and a start signal to generate a first control signal. The first AND gate receives a second clock signal and the first control signal to generate a first gate signal. The second gate driver comprises a second shift register and a second AND gate. The second shift register receives a second clock signal and a start signal to generate a second control signal. The second AND gate receives a first clock signal and the second control signal to generate a second gate signal.

10 Claims, 7 Drawing Sheets

SYSTEMS FOR DISPLAY IMAGES INCLUDING TWO GATE DRIVERS DISPOSED ON OPPOSITE SIDES OF A PIXEL ARRAY

BACKGROUND OF THE INVENTION

1. Field of the Invention

The invention relates to a gate driver, and more particularly to a double side gate driver disposed on a display panel.

2. Description of the Related Art

FIG. 1 is a schematic diagram of a conventional display panel. In FIG. 1, the pixel array 12 and the gate driver 11 for driving the pixel array 12 are disposed on the substrate 10. The gate driver 11 has a plurality of driving units, such as the driving unit 13, and each driving unit drives a corresponding gate line of the pixel array 12. The gate driver 11 is disposed on only one side of the pixel array 12, and if the pixel array 12 is a high resolution pixel array, the layout area of the gate driver 11 increases. For example, if the layout area required for the driving unit 13 is XY, i.e. the width of the layout area is X and the length of the layout area is Y, and the number of the gate lines is twice the original, the required layout area is twice the original, thus, this might decrease the area of the pixel array or the area of the substrate 10 might increase.

BRIEF SUMMARY OF THE INVENTION

Systems for displaying images are provided. An exemplary embodiment of such a system comprises a display panel comprising a pixel array, a first gate driver and a second gate driver. The first gate driver is disposed on a first side of the pixel array and the second gate driver is disposed on a second side opposing the first side. The first gate driver comprises a first shift register and a first AND gate. The first shift register receives a first clock signal and a start signal to generate a first control signal. The first AND gate receives a second clock signal and the first control signal to generate a first gate signal. The second gate driving unit comprises a second shift register and a second AND gate. The second shift register receives a second clock signal and a start signal to generate a second control signal. The second AND gate receives a first clock signal and the second control signal to generate a second gate signal.

When the first clock signal and the start signal are high, the first control signal is high. When the second clock signal and the first control signal are high, the first gate signal is high. When the first gate signal and the second signal are high, the second control signal is high. When the second control signal and the first clock signal are high, the second gate signal is high.

Another exemplary embodiment of a system for displaying images further comprises a level shifter to increase the driving ability of the first gate signal.

The invention further provides a driving method for a pixel array having a first shift register disposed on one side of the pixel array and a second shift register disposed on a second side opposing to the first side, comprising: inputting a start signal to the first shift register; generating a first enable signal when the start signal and a first clock signal are high; generating and transmitting a first driving signal to the second shift register to generate a second enable signal when the first enable signal and a second clock signal are high; generating a second driving signal when the second enable signal and the first clock signal are high.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
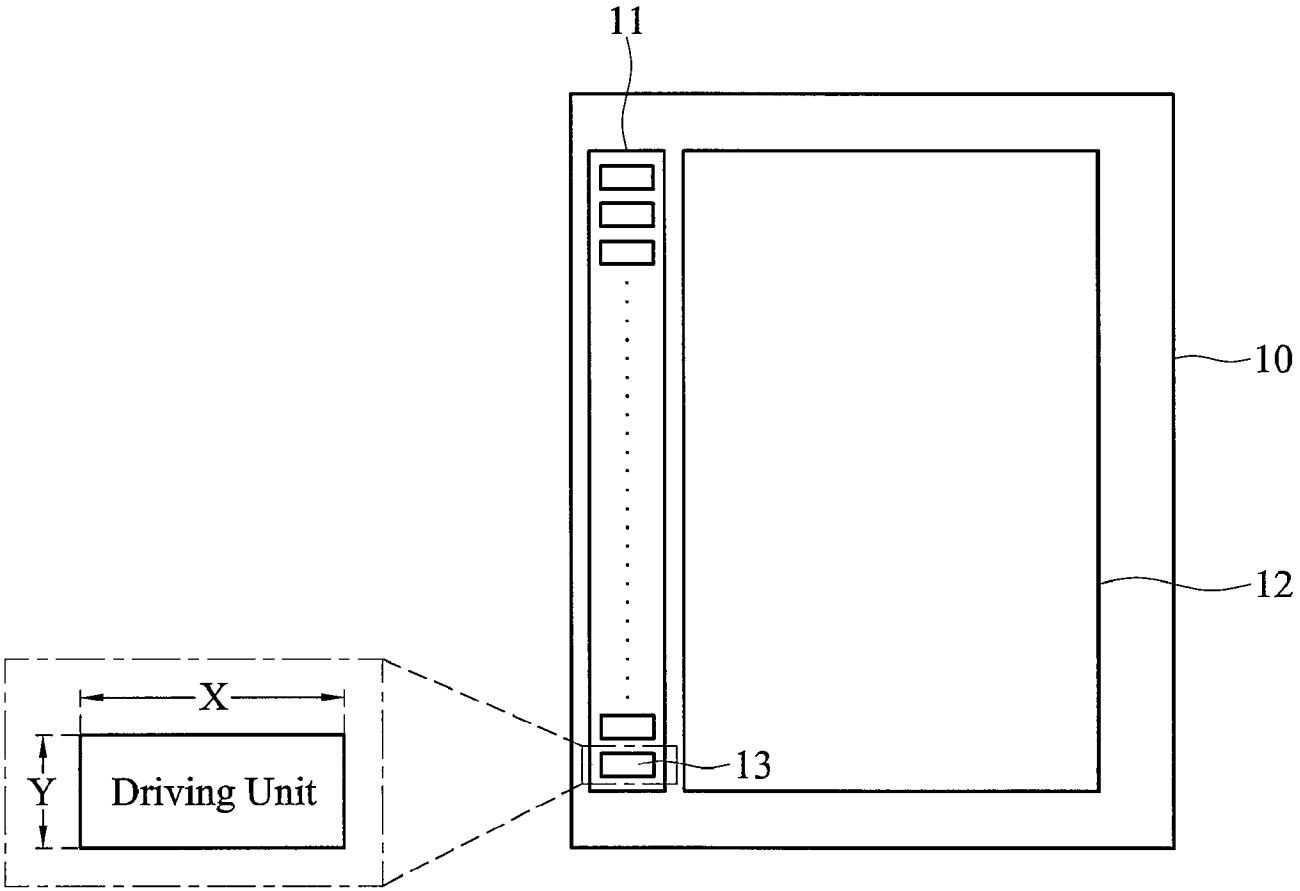
FIG. 1 (RELATED ART)
FIG. 1 is a schematic diagram of a conventional display panel.
Figure 2:
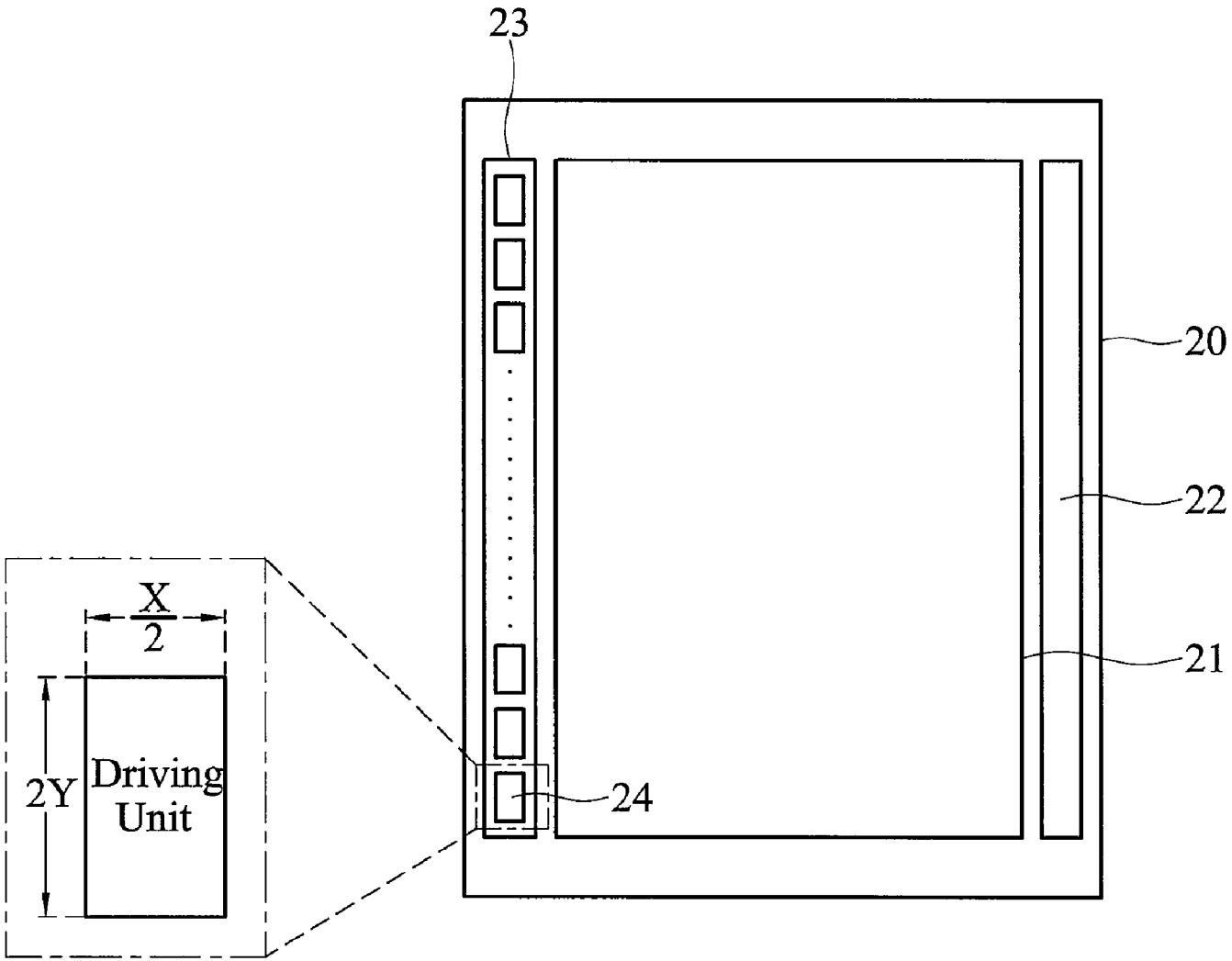
FIG. 2 is a schematic diagram of an embodiment of a display panel of the invention.

FIG. 2 is a schematic diagram of an embodiment of a display panel of the invention. The display panel 20 comprises a first gate driver 23, a second gate driver 22 and a pixel array 21. The first gate driver 23 is disposed on a first side of the pixel array and the second gate driver 22 is disposed on a second side opposing the first side. The first gate driver 23 and the second gate driver 22 sequentially drive the gate lines of the pixel array 21 (not shown in FIG. 2) based on control signals from a timing controller (not shown in FIG. 2). The first gate driver 23 and the second gate driver 22 comprise a plurality of driving units, such as the driving unit 24. Since the gate driver is separated into two gate drivers, first gate driver 23 and second gate driver 22, the width of the layout area of each driving unit is X/2, and the length of the layout area of each driving unit is 2Y, thus, the layout area of each driving unit is the same as the layout area of driving unit 13 of FIG. 1. FIG. 2 illustrates a preferable arrangement.

Figure 3:
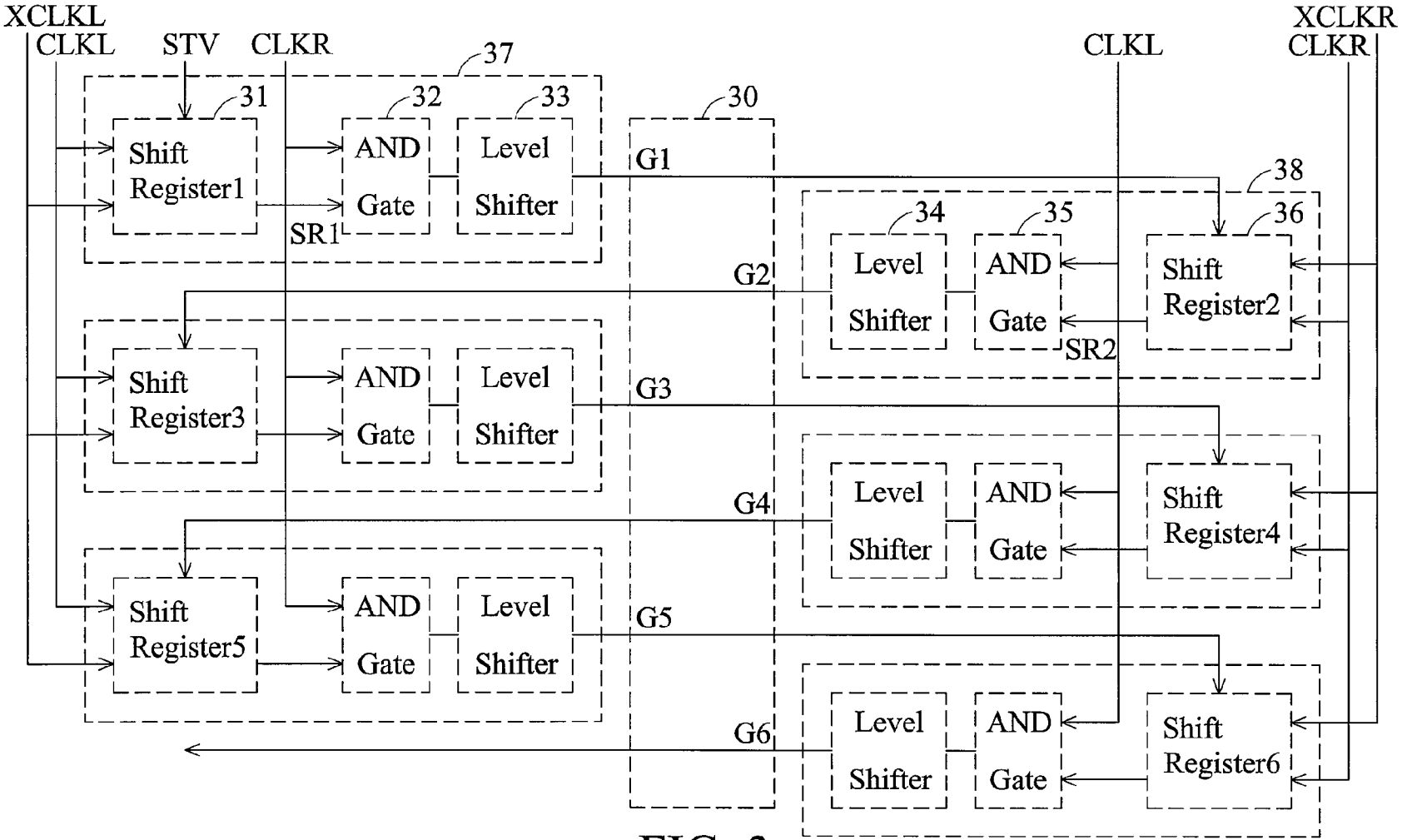
FIG. 3 is a block diagram of another embodiment of a display panel of the invention.

FIG. 3 is a block diagram of another embodiment of a display panel of the invention. The display panel comprises a pixel array 30, a first gate driver and a second gate driver. The first gate driver and the second gate driver comprise a plurality of gate driving units, such as driving unit 37 and 38. In this embodiment, a first gate driving unit comprises a shift register 1 31, a AND gate 32 and a level shifter 33, and a second gate driving unit comprises a shift register 2 36, a AND gate 35 and a level shifter 34. Shift registers 1, 3 and 5 are disposed on a first side of the pixel array 30 and the second gate driver comprises shifter registers 2, 4 and 6 are disposed on a second side opposite to the first side. The shift register 1 31 receives a start signal, STV, a first clock signal CLKL and a first inverted clock signal XCLKL, outputs a first control signal SR1 when the first clock signal and the STV signal are high. The AND gate 32 receives a second clock signal and the first control signal SR1, outputs a driving signal when the second clock signal CLKR and the first control signal SR1 are high. The level shifter 33 receives and increases the driving ability of the driving signal, i.e., the current carried by the driving signal is increased, to output the gate signal G1. The gate signal G1 is transmitted through a corresponding gate line. When the shift register 2 36 receives the gate signal G1, and the second clock signal CLKR is high, the control signal SR2 output by the shift register 2 36 is high. Then, when the first clock signal CLKL is high, the gate signal G2 is high. According to the described operation, each shift register can be activated by the gate signal from a pre-stage shift register, wherein when the shift register is the first shift register, the first shift register is activated by a start signal, such as signal STV.

Figure 4:
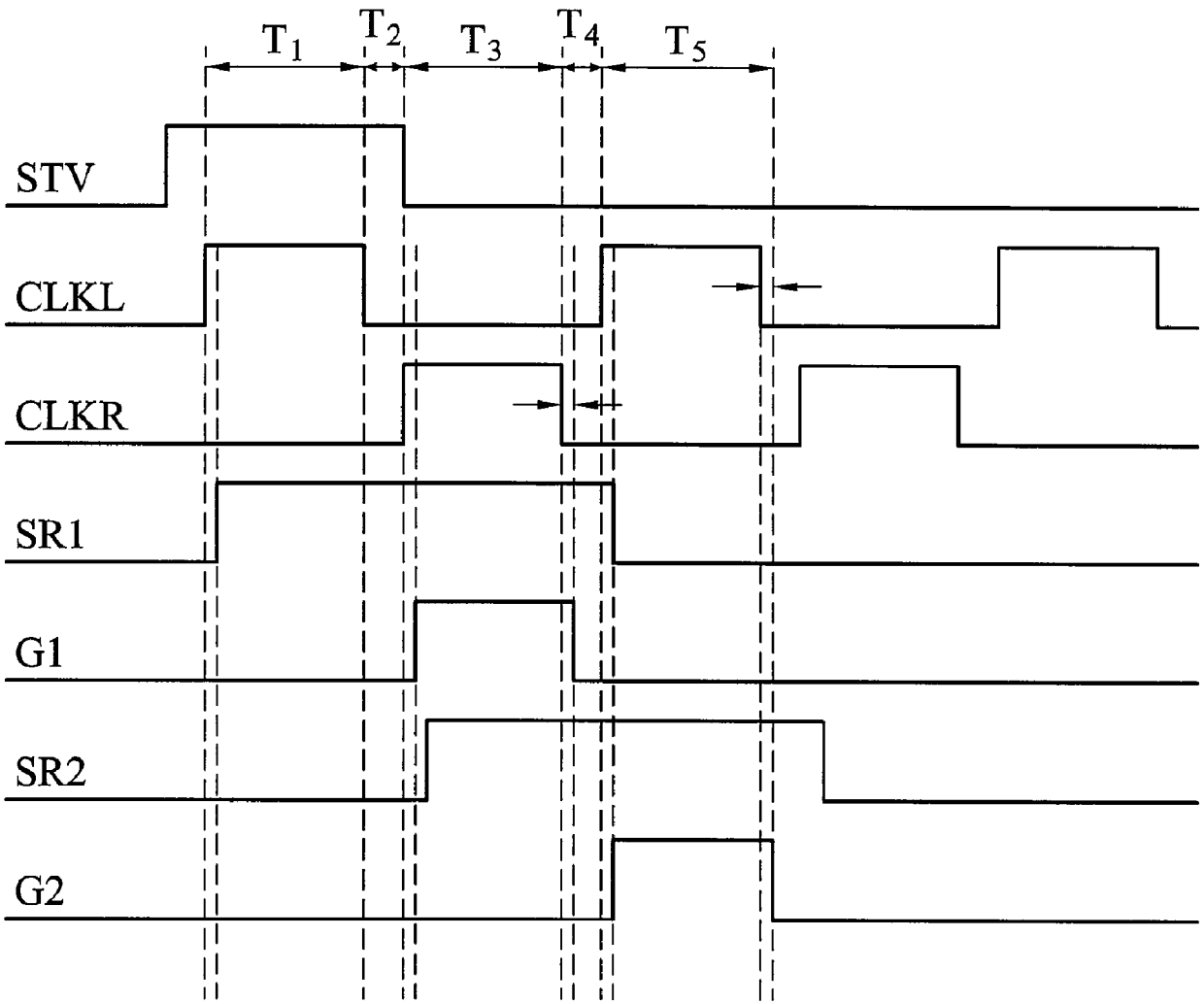
FIG. 4 is a timing chart of the embodiment of FIG. 3.

To further illustrate the operation of the embodiment of FIG. 3, please refer to FIG. 4. FIG. 4 is a timing chart of the embodiment of FIG. 3. At time T1, the STV signal and the first clock signal CLKL are high, the first control signal SR1 is high. At time T2, the first clock signal is low and the first control signal SR1 remains high because the first control signal is latched in shift register 1. At time T3, the second clock signal CLKR and the first control signal SR1 are high, thus, the gate signal G1 is determined to be high by AND gate 32. The second control signal SR2 generated by the shift register 2 36 is high because the gate signal G1 and the second clock signal are high. At time T4, the second clock signal CLKR becomes low, thus, the gate signal G1 becomes low, but the second control signal remains high. At time T5, the first clock signal CLKL and the STV signal are low, thus, the first control signal is low, and the gate signal G2 is high due to the first clock signal and the second control signal. As to the shift registers 3, 4, 5 and 6, the operations thereof are similar to the operation of shift register 1 31 or shift register 2 36.

In FIG. 4, notice that the first clock signal CLKL does not overlap the second clock signal CLKR. To prevent overlap, the first clock signal CLKL and the second clock signal CLKR can be generated by a non-overlap clock generator. Another method comprises generating a first clock signal, wherein the duty cycle thereof is less than 50%, generating a second clock signal by applying a phase delay to the first clock signal. Yet, another method for generating non-overlap signals comprises generating a first clock signal, generating an inverted first clock signal, adjusting the duty cycle of the first clock signal and the inverted first clock signal to eliminate overlap.

Figure 5:
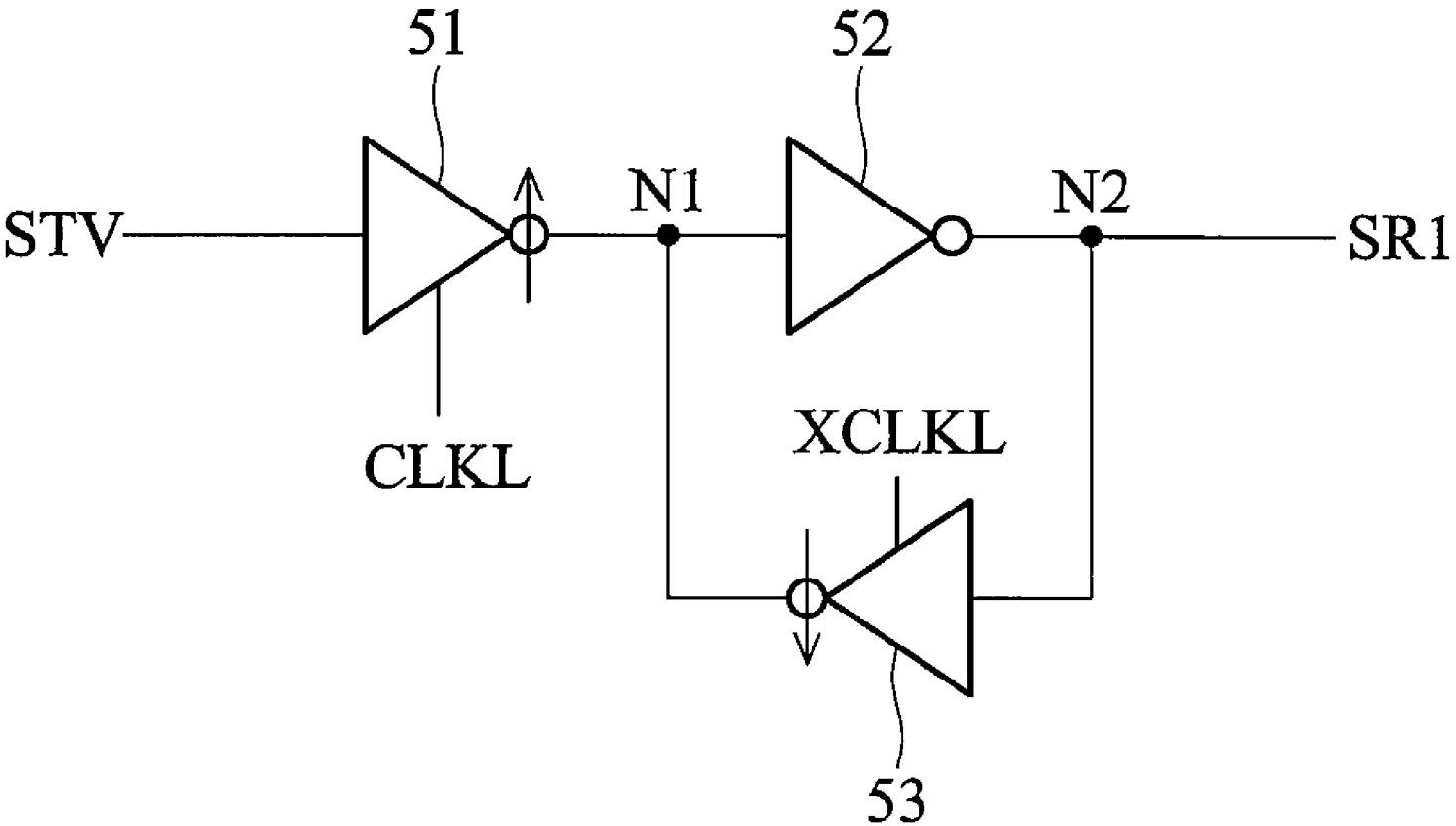
FIG. 5 is a circuit diagram of an embodiment of the shift register of the invention.

FIG. 5 is a circuit diagram of an embodiment of the shift register 1 of FIG. 3. Elements 51 and 53 are clock inverters, wherein the clock inverter 51 is activated when the clock signal is high, and the clock inverter 53 is activated when the clock signal is low. The clock inverter 51 controlled by the first clock signal CLKL, has an input receiving the STV signal and an output coupled to a node N1. The inverter 52 has an input coupled to the node N1 and an output coupled to a node N2, outputting the first control signal SR1. The clock inverter 53 controlled by the inverted first clock signal XCLKL, has an input coupled to the node N2 and an output coupled to the node N1.

Figure 6:
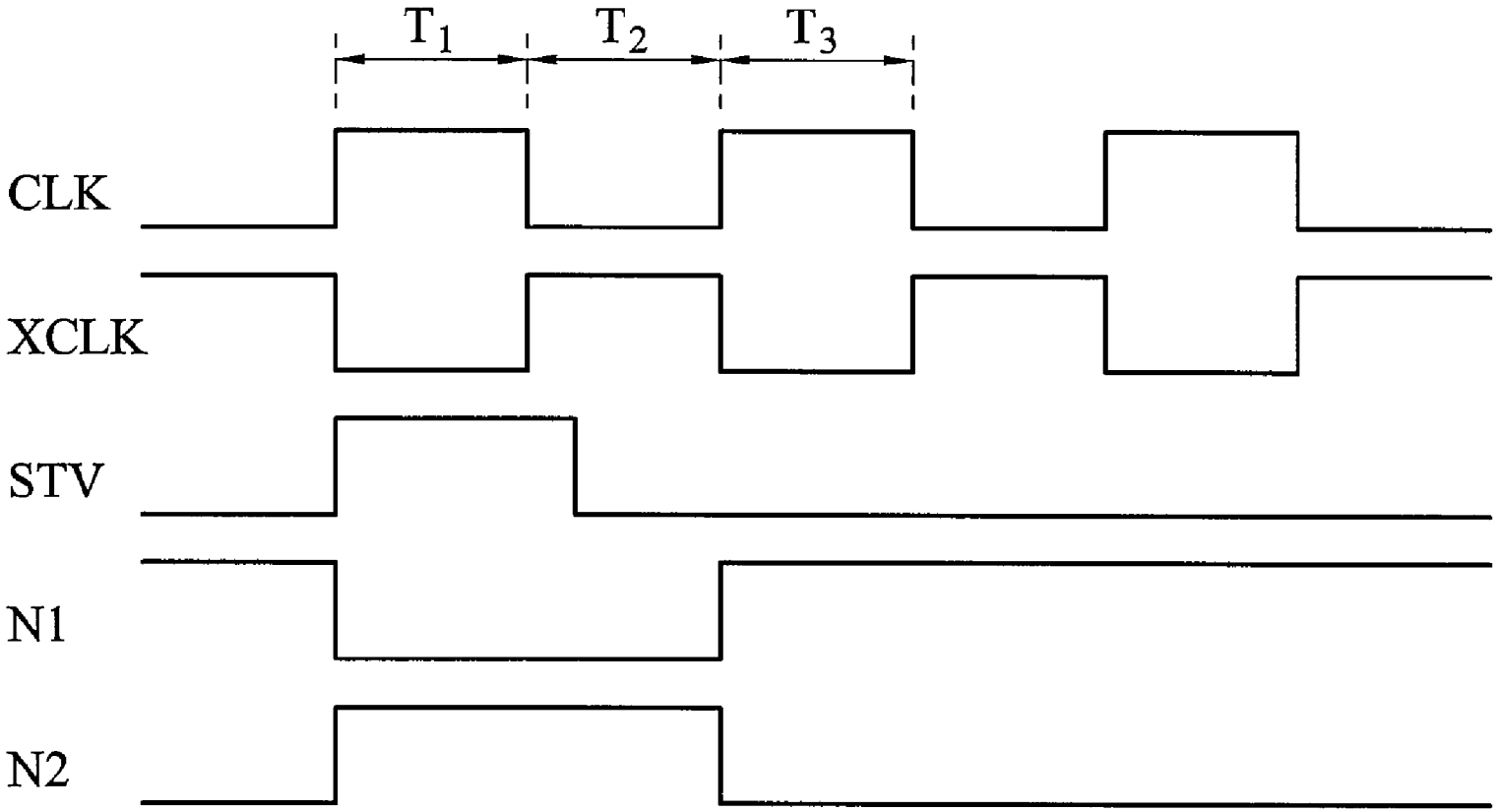
FIG. 6 is a timing chart of the embodiment of the shift register of FIG. 5.

To further illustrate the operation of the embodiment of FIG. 5, please refer to FIG. 6. FIG. 6 is a timing chart of the embodiment of the shift register of FIG. 5. In FIG. 6, the clock signal CLK represents the first clock signal CLKL and the clock signal XCLK represents the inverted first clock signal XCLKL. At time T1, the clock signal CLK is high, thus the clock inverter 51 is activated, and meantime the STV signal is high, thus a low signal is acquired at the node N1 and a high signal is acquired at the node N2. At time T2, the clock signal CLK is low, thus the clock inverter 51 turns off, and meantime the clock inverter 53 is activated due to the clock signal XCLK. Since the clock inverter 51 turns off, the first control signal SR1 is latched in a loop formed by the clock inverter 53 and the inverter 52. At time T3, the clock inverter 51 is activated and the STV signal is low, thus a high signal is acquired at the node N1 and the first control signal SR1 is low.

Figure 7:
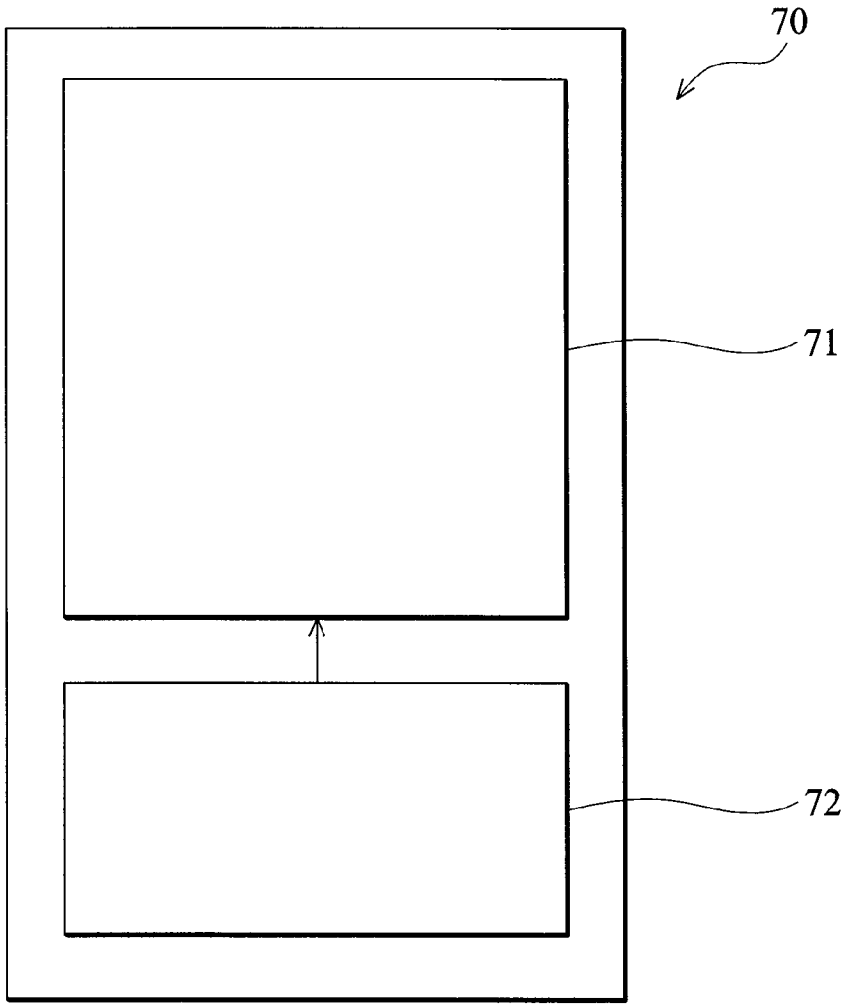
FIG. 7 is a block diagram of another embodiment of an electronic device of the invention.

FIG. 7 schematically shows another embodiment of a system for displaying images which, in this case, is implemented as a display panel 71 or an electronic device 70. The electronic device 70 comprises an input device 72 and a display panel 71 (such as display panel 20 shown in FIG. 2). The input device 72 is operative to provide input to the display panel 71 such that the display panel displays images. In exemplary embodiments, the electronic device 70 is a mobile phone, digital camera, PDA (personal digital assistant), notebook computer, desktop computer, television, car display, or portable DVD player.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying images, comprising:
- a pixel array;
- a first gate driver disposed on a first side of the pixel array, comprising:
  - a first shift register receiving a first clock signal and a start signal to generate a first control signal; and
  - a first AND gate receiving a second clock signal and the first control signal to generate a first gate signal; and
- a second gate driver disposed on a second side opposing to the first side, comprising:
- a second shift register receiving the first gate signal and the second clock signal to generate a second control signal; and
- a second AND gate receiving the first clock signal and the second control signal to generate a second gate signal.

2. The system as claimed in claim 1, wherein a duty cycle of the first clock signal is less than 50%.

3. The system as claimed in claim 1, wherein a duty cycle of the second clock signal is less than 50%.

4. The system as claimed in claim 1, wherein the first clock signal is a non-overlap clock signal with the second clock signal.

5. The system as claimed in claim 1, wherein the first clock signal and the second clock signal are generated by a non-overlap clock signal generator.

6. The system as claimed in claim 1, wherein the first shift register comprises:
- a first clock inverter having an input terminal receiving the start signal and an output terminal, activated when the first clock signal is high;
- a first inverter having an input terminal coupled to the output terminal of the first clock inverter, and an output terminal for outputting the first control signal; and
- a second clock inverter having an input terminal coupled to the output terminal of the first inverter, and an output terminal coupled to the output terminal of the first clock inverter.

7. The system as claimed in claim 1, wherein the first gate driver having a plurality of first driving units and the second gate driver having a plurality of second driving units.

8. The system as claimed in claim 1, further comprising a display panel, wherein the pixel array, the first driving unit and the second driving unit forms a portion of the display panel.

9. The system as claimed in claim 8, further comprising an electronic device, wherein the electronic device comprises:

the display panel; and an input device coupled to the display panel and operative to provide input to the display panel such that the display panel displays images.

10. The system as claimed in claim 9, wherein the electronic device is a mobile phone, digital camera, PDA (personal digital assistant), notebook computer, desktop computer, television, car display, or portable DVD player.

* * * * *